United States Patent [19]

Whigham et al.

[11] Patent Number: 5,033,651

[45] Date of Patent: Jul. 23, 1991

[54] NOZZLE FOR POSTMIX BEVERAGE DISPENSER

[75] Inventors: Roger C. Whigham, Atlanta; Annie T. Ellis, Smyrna; Daniel S. Quartarone, Stone Mountain, all of Ga.

[73] Assignee: The Coca-Cola Company, Atlanta, Ga.

[21] Appl. No.: 490,181

[22] Filed: Mar. 8, 1990

Related U.S. Application Data

[63] Continuation-in-part of Ser. No. 307,663, Feb. 6, 1989, abandoned.

[51] Int. Cl.[5] ..... B67D 5/56; B67D 5/60

[52] U.S. Cl. ..... 222/145; 222/1; 222/129.1; 222/132; 239/432

[58] Field of Search ..... 222/1, 129.1, 129.2, 222/129.3, 129.4, 132, 145; 239/417.5, 423, 432

[56] References Cited

U.S. PATENT DOCUMENTS

| | | | |
|---|---|---|---|
| 3,009,653 | 11/1961 | Hedeman | 222/129.4 X |
| 3,349,968 | 10/1967 | Yuza | 222/132 |
| 3,373,937 | 3/1968 | Yuza | 239/423 X |
| 3,625,402 | 12/1971 | Kulis | 222/129.3 |
| 3,800,826 | 4/1974 | McCann | 222/129.1 X |
| 3,966,091 | 6/1976 | Bencic | 222/129.1 |
| 4,218,014 | 8/1980 | Tracy | 222/145 X |
| 4,270,673 | 6/1981 | Rodth | 222/145 X |
| 4,509,690 | 4/1985 | Austin et al. | 222/129.1 X |
| 4,619,378 | 10/1986 | de Man | 222/129.2 X |
| 4,741,355 | 5/1988 | Credle, Jr. et al. | 222/129.1 X |
| 4,928,854 | 5/1990 | McCann et al. | 222/129.1 |
| 4,986,447 | 1/1991 | McCann et al. | 222/145 X |

*Primary Examiner*—Kevin P. Shaver

*Attorney, Agent, or Firm*—Thomas R. Boston; W. Dexter Brooks

[57] ABSTRACT

A nozzle, preferably a multiflavor nozzle, for a postmix beverage dispenser and a method for dispensing including a nozzle body, a water passageway and one or a plurality of separate syrup passageways therethrough, wherein the water passageway includes a water inlet chamber, a plurality of small holes leading into a water stream shaping passageway which includes a first, radially extending annular chamber leading into a second axially extending annular chamber and then to an annular exit port to produce an even, uniform, hollow cylindrical stream of water surrounding a syrup stream. The $CO_2$ comes out of solution in the water passageway to prevent foaming and no mixing occurs in the nozzle to prevent flavor carry-over, while providing high carbonation retention and minimizing brix stratification.

34 Claims, 8 Drawing Sheets

NOZZLE FOR POSTMIX BEVERAGE DISPENSER

CROSS-REFERENCE TO RELATED APPLICATION

This is a continuation-in-part of copending U.S. application Ser. No. 07/307,663 filed Feb. 6, 1989, now abandoned, entitled Multiflavor Nozzle For Postmix Beverage Dispenser and is assigned to the same assignee.

BACKGROUND OF THE INVENTION

This invention relates to a nozzle for a postmix beverage dispenser, and in a preferred embodiment to a multiflavor nozzle.

Nozzles are known, however, they are subject to the problems of foaming and known multiflavor nozzles are subject to the problem of flavor carry-over when switching from one flavor to another. When carbonated water is under pressure and the pressure is reduced, the $CO_2$ which was in solution at high pressures begins to come out of solution. If the soda water is in contact with the syrup during the period when $CO_2$ is coming out of solution, foaming will occur. In addition, when mixing of syrup and water occurs in the nozzle, some syrup may remain in the nozzle and be mixed in with the next beverage dispensed, which if it is a different flavor, may cause a flavor carry-over problem. Other problems associated with known nozzles are unsatisfactory brix stratification and unsatisfactorily low carbonation retention.

SUMMARY OF THE INVENTION

It is an object of the present invention to provide an improved multiflavor nozzle that substantially eliminates or minimizes the above-mentioned problems in known nozzles.

The nozzle of the present invention includes a nozzle body having a water passageway and a plurality of separate syrup passageways therethrough. Either carbonated or non-carbonated water can be fed through the water passageway. Each of the syrup passageways extends from one of a plurality of spaced apart syrup inlet ports in a top surface of the nozzle body to one of a plurality of equally, circumferentially, spaced apart, syrup outlet ports in a bottom surface of the nozzle body and located radially inside of an annular water outlet port also in such bottom surface. The water passageway includes an inlet chamber, a plurality of small holes leading into an expansion chamber to provide the majority of the pressure drop, and then a water stream shaping device including a plurality of separate axial passages leading into a radially extending annular chamber, leading in turn into an axially extending annular chamber, from which the water exits as a uniform cylindrical stream located radially outwardly of the plurality of separate syrup outlet ports.

The preferred nozzle of the present invention includes a nozzle body having a water passageway and either one or a plurality of separate syrup passageways therethrough. Either carbonated or non-carbonated water can be fed through the water passageway. Each of the syrup passageways extends vertically straight down through a central cylinder of the nozzle body to one of a plurality of equally, circumferentially, spaced apart, syrup outlet ports in a bottom surface of the nozzle. The syrup outlet ports are located radially inside of an annular water outlet port also in the bottom of the nozzle. The water passageway includes a plurality of separate, spaced-apart water passages leading to a single annular inlet chamber in the nozzle body. A plurality of small holes lead from the inlet chamber into a water stream shaping device including first a radially extending annular chamber and secondly an axially extending annular chamber. The water exits the second axially extending chamber as a uniform cylindrical stream located radially outwardly of the plurality of separate syrup outlet ports.

These nozzles allow ample time for the $CO_2$ to come out of solution in the carbonated water passageway and for the water to stabilize before the syrup comes into contact with the water at some location below the distal end of the nozzle. The selected syrup exits into the middle of the cylindrical water stream. Some mixing occurs in the stream and additional mixing occurs in the cup. Because no mixing occurs in these nozzles, flavor carry-over is minimized. In addition, these nozzles provide high carbonation retention and minimized brix stratification.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
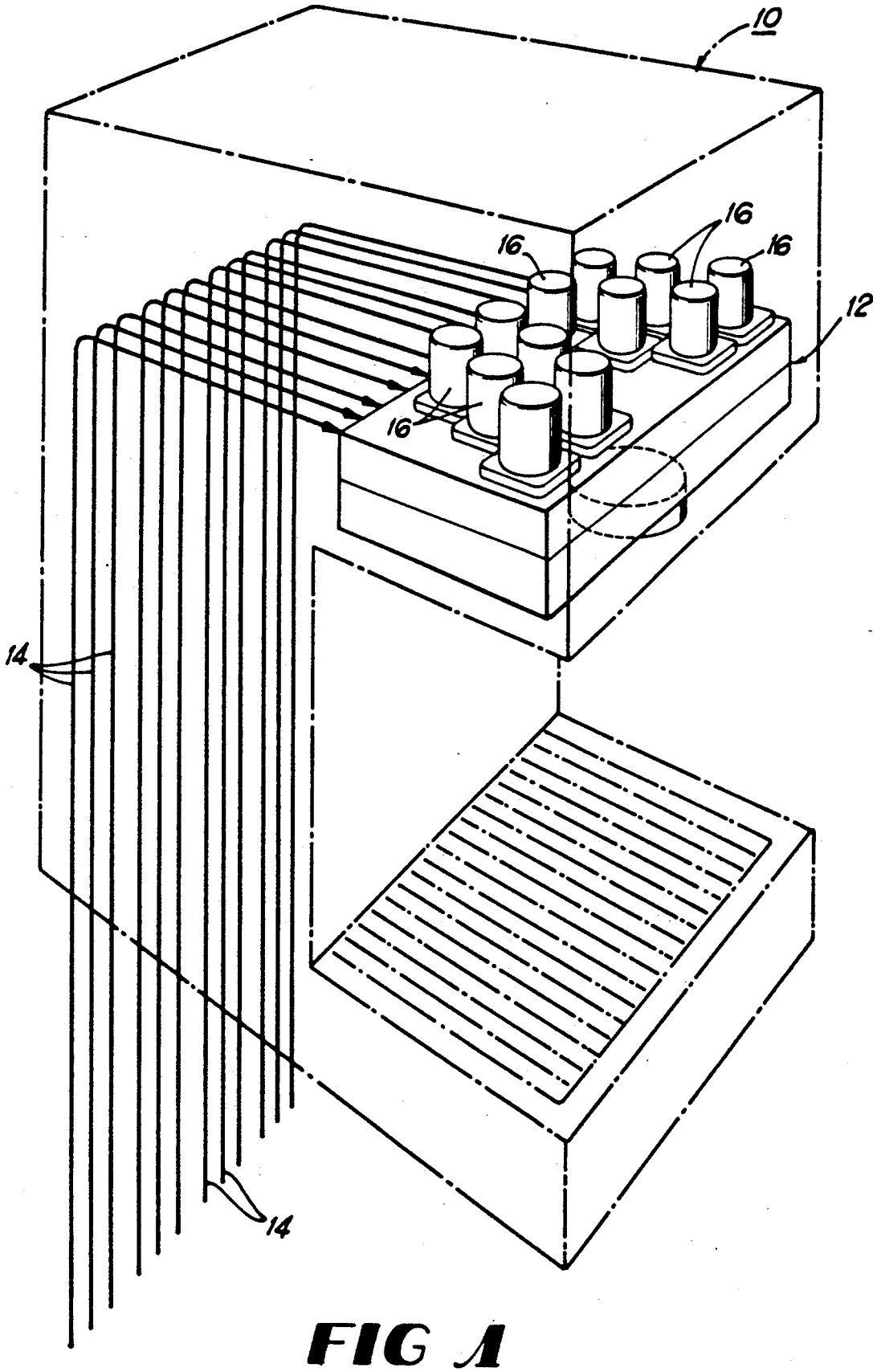
FIG. 1 is a schematic perspective view of a postmix beverage dispenser in which a nozzle of this invention can be used.
Figure 2:
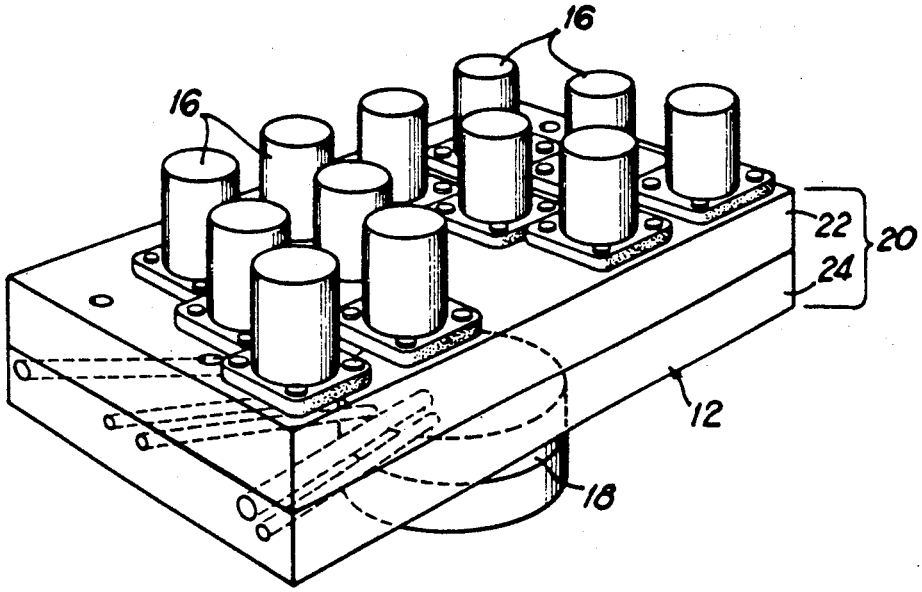
FIG. 2 is a perspective view of a nozzle assembly according to one embodiment of the present invention.
Figure 3:
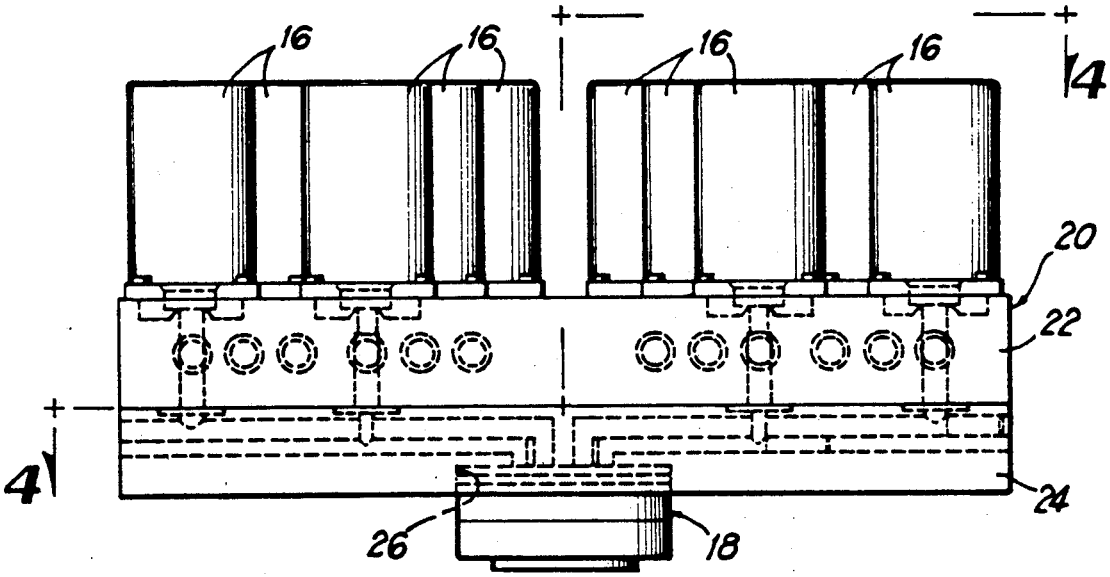
FIG. 3 is a front side view of the nozzle assembly of FIG. 2.
Figure 4:
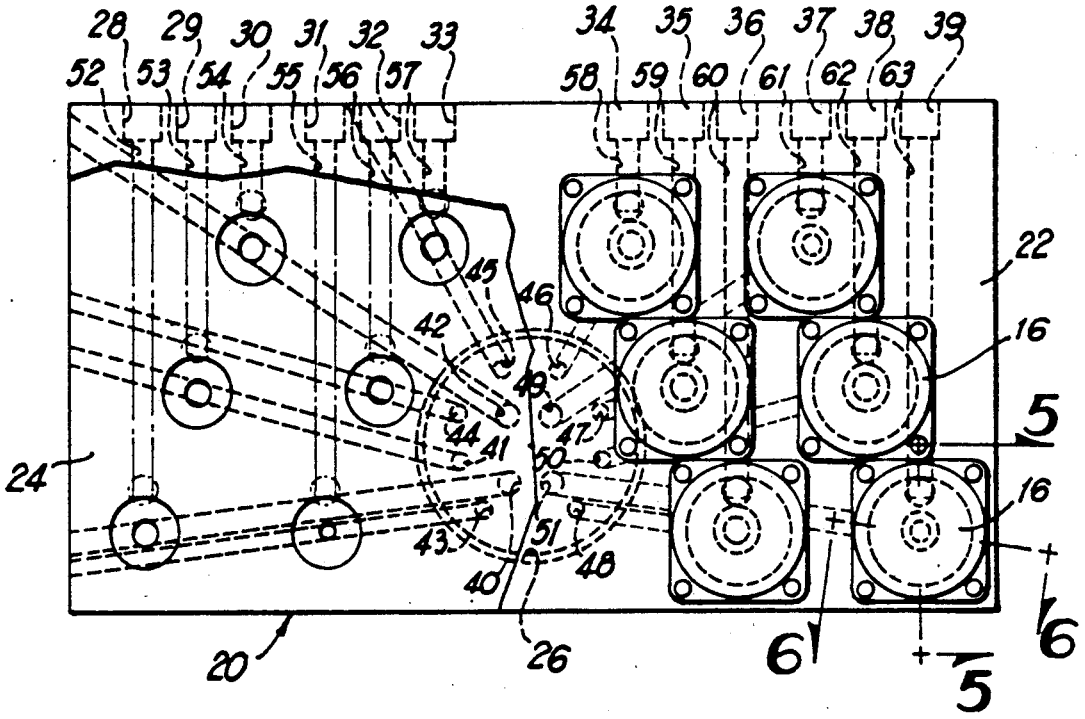
FIG. 4 is a partly broken away top plan view of the nozzle assembly of FIGS. 2 and 3.
Figure 5:
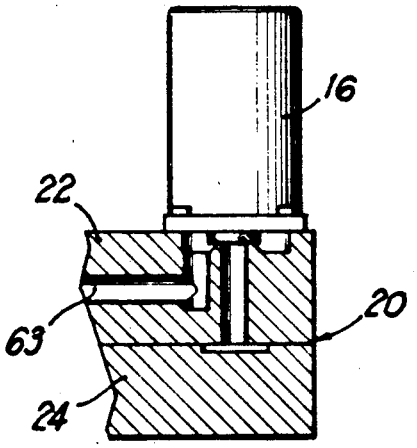
FIG. 5 is a partial, side cross-sectional view taken along line 5—5 of FIG. 4.
Figure 6:
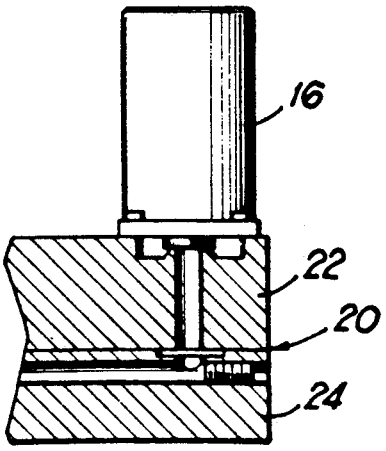
FIG. 6 is a partial, side cross-sectional view taken along line 6—6 of FIG. 4.

With reference now to the drawings, FIG. 1 shows, diagrammatically, a beverage dispenser 10 that can be used with either of the nozzle assemblies and nozzles of the present invention. It is noted that other numbers (for example one to eight or more) of syrups (flavors) can alternatively be used. The beverage dispenser 10 can include other components known in the art, but since they are not part of this invention, they are not described herein.

FIG. 1 shows one embodiment of the present invention of twelve liquid conduits 14 coming into a nozzle assembly 12 which has twelve solenoid controlled valves 16 for controlling the flow through the nozzle assembly 12. Of the twelve conduits, eight are for syrup, two for still water, and two for carbonated water (or soda water).

Figure 7:
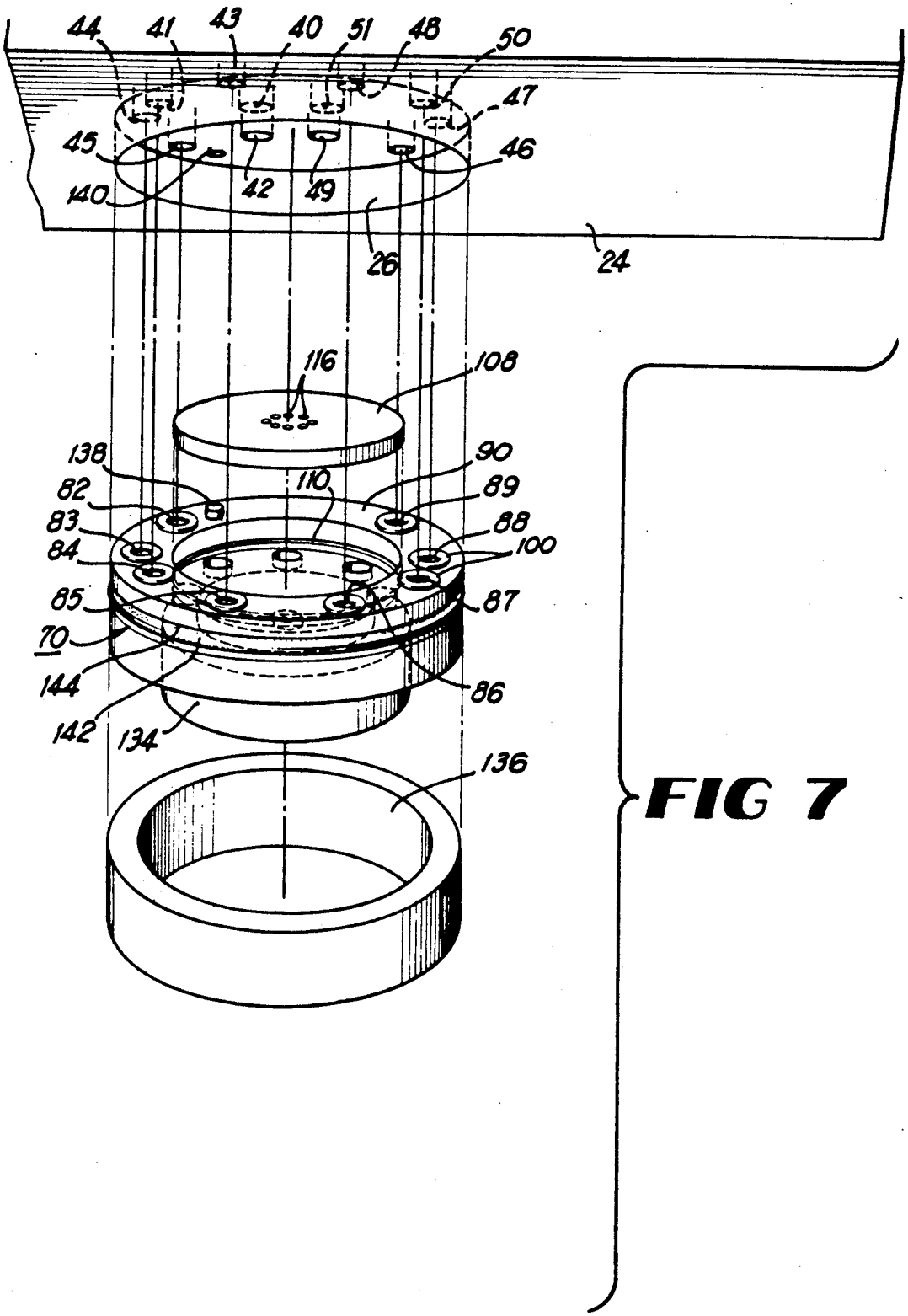
FIG. 7 is an exploded, perspective view of a nozzle according to one embodiment of this invention.
Figure 8:
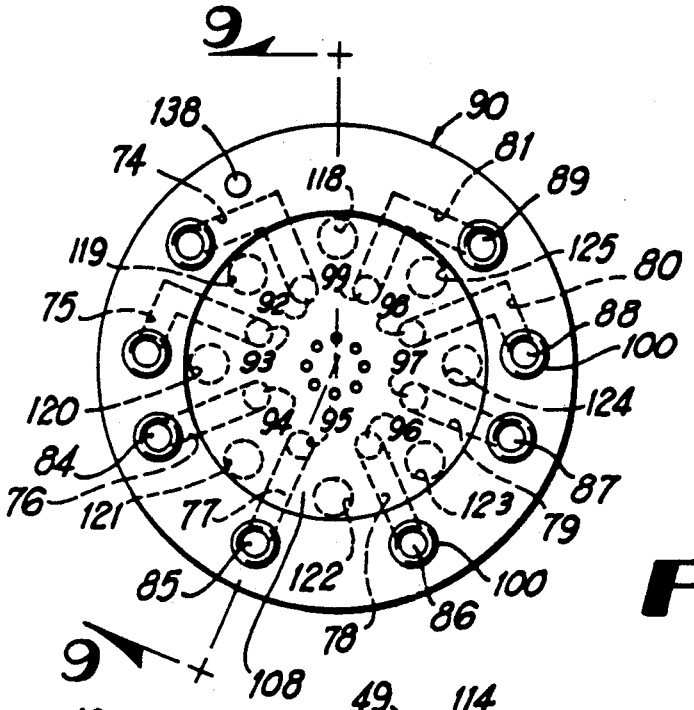
FIG. 8 is a top plan view of the nozzle of FIG. 7.
Figure 9:
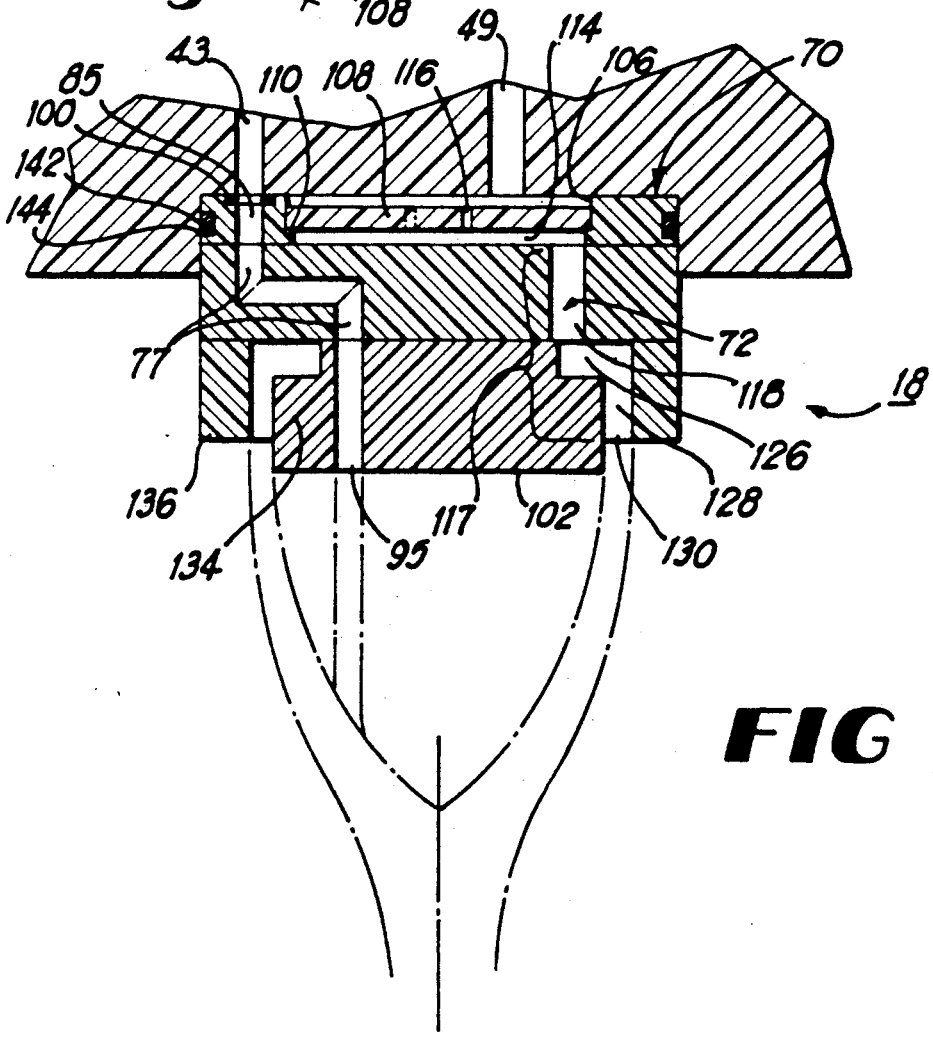
FIG. 9 is a cross-sectional side view of the nozzle of FIG. 7 taken along line 9—9 of FIG. 8.
Figure 10:
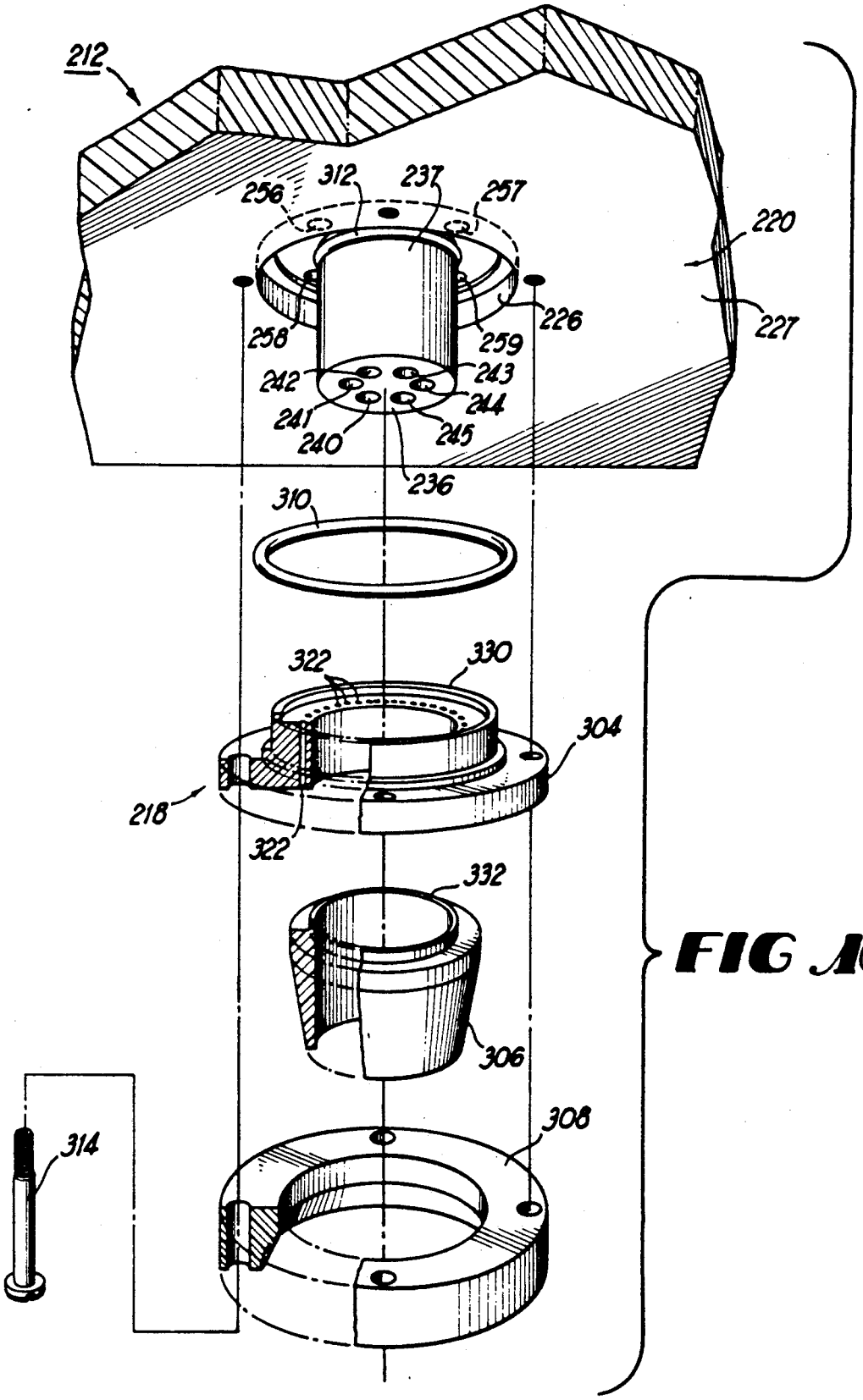
FIG. 10 is an exploded, perspective view of a nozzle according to a second embodiment of this invention.

FIGS. 2–7 show the details of the nozzle assembly 12 and FIGS. 7–9 show the details of a nozzle 18 according to a first embodiment of the present invention.

FIGS. 10–13 show the details of a nozzle and nozzle assembly according to a second embodiment of this invention.

The nozzle assembly 12 includes a solenoid block 20 connected to the nozzle 18. The solenoid block 20 includes an upper block 22, a lower block 24, a circular recess 26 in its bottom surface to receive the nozzle 18, twelve inlet ports 28–39, twelve outlet ports 40–51 in the recess 26, twelve liquid passages 52–63 connecting the inlet and outlet ports, and twelve solenoid valves 16, one for each liquid passage.

Passages 52 and 54 are for still water, passages 59 and 61 are for carbonated water, and the remaining eight passages are syrup passages. The solenoid controlled valves are clearly shown in FIGS. 5 and 6.

The nozzle 18 will now be described with reference to FIGS. 7–9. The nozzle 18 includes a nozzle body 70 having a water passageway 72 and eight separate syrup passageways 74–81 therethrough.

Each of the syrup passageways 74–81 extend from one of a plurality of separate, circumferentially spaced apart syrup inlet ports 82–89 on a top surface 90 of the nozzle body 70 to a respective one of a plurality of separate syrup outlet ports 92–99 on a bottom surface 102 of the body. Each of the inlet ports 82–19 includes an O-ring seal 100. The syrup outlet ports 92—92 are preferably equally circumferentially spaced apart on the bottom surface 102 of the nozzle body 70 and are located inside of the exiting, cylindrical water stream 104 to be described below. Different numbers and shapes of syrup passageways, and different locations of the inlet and outlet ports and different sealing means, can be used, as desired.

The nozzle body includes a circular recess 106 in its top surface 90, in which a disc 108 is located resting on a shoulder 110. The disc separates the recess 106 into a water inlet chamber 112 and an expansion chamber 114. The disc has a plurality, preferably eight, of small, equally spaced apart water inlet holes 116, preferably having a diameter of 0.065 inch. These holes take the majority of the pressure drop. Downstream of these holes, the water spreads out in the expansion chamber 114 and then leaves the expansion chamber through eight equally circumferentially spaced apart water ports.

Downstream from these ports is a water stream shaping device 117. This stream shaping device includes eight axially extending water passages 118–125, then a radially outwardly extending first annular chamber 126, and lastly an axially extending second annular chamber 128, the distal end of which is an annular water outlet port 130 through which a uniform and even cylindrical water stream 104 exits the nozzle 18.

This stream shaping device 117 preferably consists of a solid cylindrical element 134 having an outside diameter of 1.75 inch surrounded by a second cylindrical member 136 having an inside diameter of 2.00 inch (although member 136 is shown exploded apart from the rest of the nozzle in FIG. 7, it is actually glued to the rest of the nozzle in final assembly). As the water exits the eight water passages 118–125, it strikes the top of the element 134. The water then flows radially outwardly toward the member 136 through the first annular chamber 126 in which it spreads out. The water is then diverted downwardly through the second annular chamber 128 in which it continues to spread out into the uniform stream 104.

To properly register the nozzle 18 in the recess 26 in the solenoid block, the nozzle is provided with a locating pin 138 that fits into a hole 140 in the block 20 when the nozzle is properly oriented. To sealingly hold the nozzle 18 to the block 20, the nozzle body 70 has an O-ring 142 in a groove 144.

While a first embodiment of this invention has been described above in detail, it is to be understood that variations and modifications can be made therein without departing from the spirit and scope of the present invention. For example, although the annular water outlet port can be at the same height as the syrup outlet ports, it is preferably about ¼ inch higher, as shown in the drawings, to achieve the best shaped water stream. While it is preferred to use eight holes 116 in the disc 108, the number can vary from about four to twelve, and the hold diameter can vary from about 0.03 to 0.125 inch. Also, while eight axial passages 118–125 are preferred, this number can vary from about four to eight, and their diameter can vary from about 0.1875 to 0.25 inch. While the width of the radial and axial chambers 126 and 128 is preferably about 0.25 inch, this can vary from about 1/32 to ⅜ inch. As stated above, the majority of the pressure drop, about 85% thereof, occurs through the holes 116. While the syrup outlet ports are radially inside of the water stream, they could also be inside. If outside, they would preferably be at an angle toward the water stream, while if inside they are preferably axially extending (with respect to the vertical axis of the nozzle). The nozzle is preferably constructed of acrylic plastic parts glued together. While the nozzle is preferably a multiflavor nozzle, it can alternatively be used as a single flavor nozzle. While the water flow path downstream from the expansion chamber could be an axial annular chamber, the shape described above is preferred to give a uniform water stream. The expansion chamber preferably has a size of 1/16 inch high by 1.58 inch in diameter. The flow rate through the nozzle is preferably around 6–7 ounces per second, for best results.

FIGS. 10–13 show the details of a nozzle 218 and a nozzle assembly 212 according to a second and preferred embodiment of the present invention.

Figure 11:
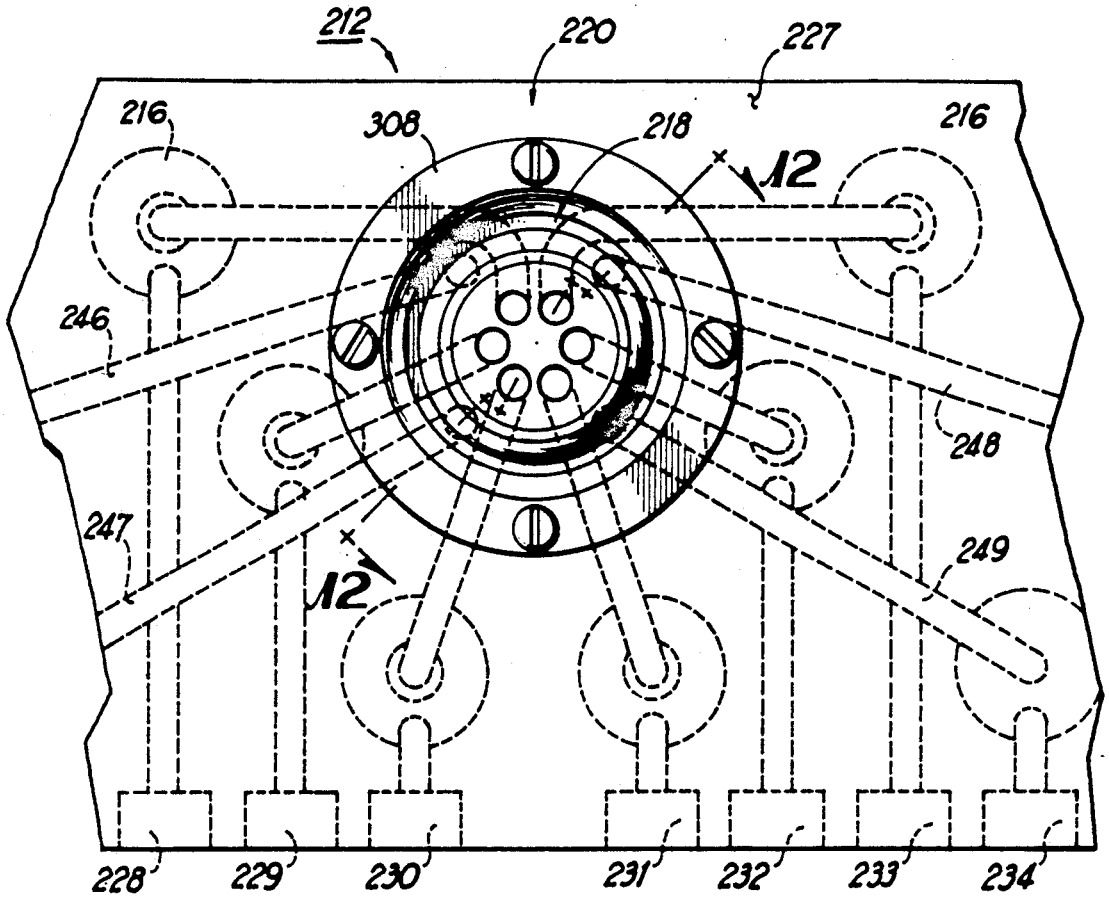
FIG. 11 is a top plan view of the nozzle of FIG. 10.
Figure 12:
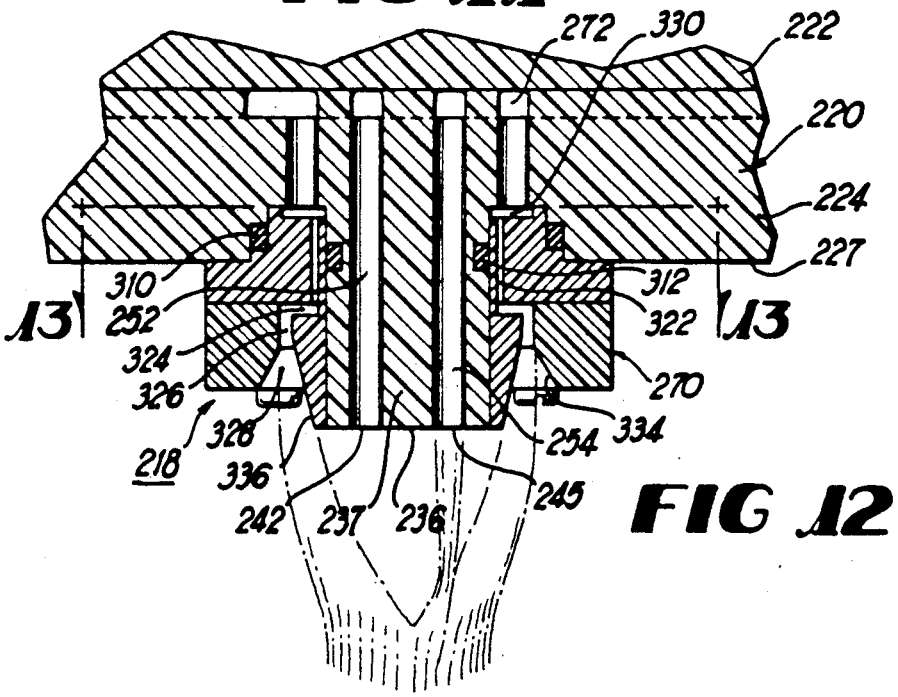
FIG. 12 is a cross-sectional view taken along line 12—12 of FIG. 11.
Figure 13:
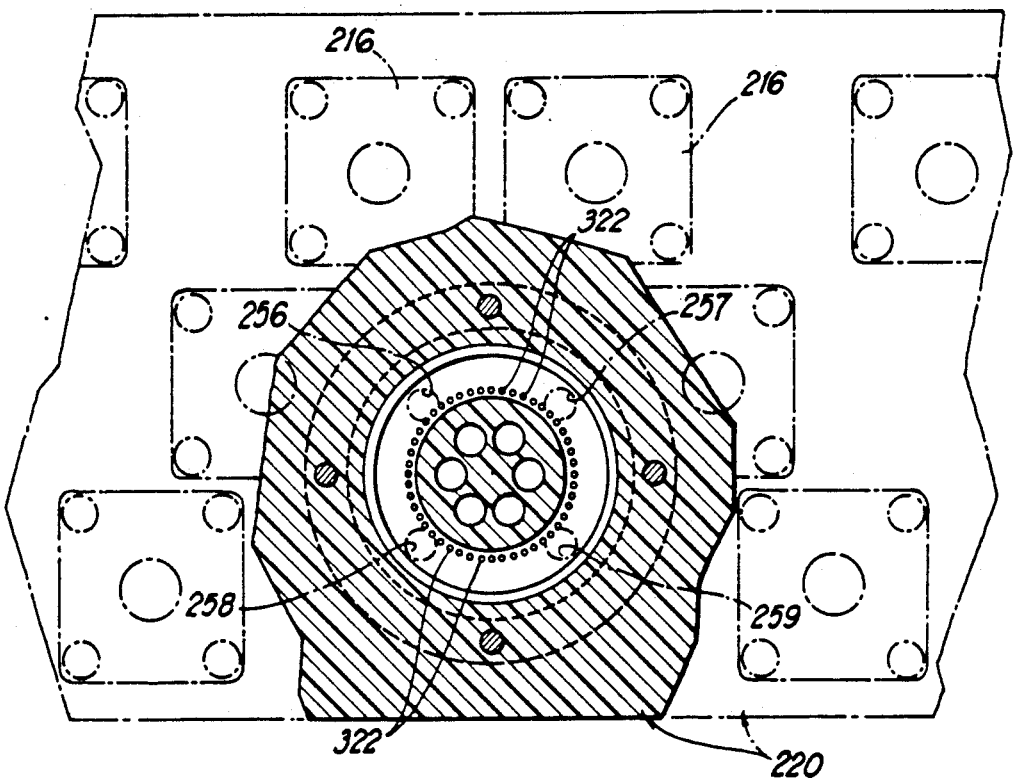
FIG. 13 is a partly broken-away top plan view of the nozzle of FIG. 10, broken away along line 13—13 of FIG. 12.

The nozzle assembly 212 includes a solenoid block 220 connected to the nozzle 218. The solenoid block 220 includes an upper block 222, a lower block 224, an annular recess 226 in the bottom surface 227 of the lower block to receive the nozzle 218, six syrup inlet ports 228–233 (see FIG. 11) in a rear surface 234 of the solenoid block 220, six syrup outlet ports 240–245 in a bottom surface 236 of a central projection or cylinder 237 (surrounded by the recess 226) that is preferably an integral part of the lower solenoid block 224, six syrup passages (two of which, 252 and 254, are shown in FIG. 12) connecting the syrup inlet and outlet ports, four water inlet ports (only one of which, 238, is shown in FIG. 11), four water outlet ports 256, 257, 258 and 259 (see FIGS. 10 and 13) in the recess 226, four water passages 246–249 connecting the water inlet and outlet ports, and ten solenoid valves 216, one for each liquid passage. Two of the water passages are preferably for still water and the other two for carbonated water.

The nozzle 218 includes a nozzle body 270 having a water passageway 272 and six separate syrup passageways (two of which, 252 and 254, are shown in FIG. 12) therethrough. In the preferred embodiment, the inlet passages that extend from the rear surface of the solenoid block to the solenoid valves are drilled in the middle of the upper block 222 and the passages that extend from the solenoid valves to the nozzle are milled in the top surface of the lower block 224. In one embodiment, the blocks are made of plexiglass.

Each of the six syrup passageways in the cylinder extend vertically straight down therethrough from one of a plurality of separate, circumferentially spaced-apart syrup openings on a top surface of the lower solenoid block to a respective one of the syrup outlet ports 240–245. The syrup outlet ports are preferably equally circumferentially spaced-apart and are located inside of the exiting, cylindrical water stream to be described below. Different numbers and shapes of syrup passageways, and different locations of the inlet and outlet ports and different sealing means, can be used, as desired.

The water passageway through the nozzle 218 includes first an annular inlet chamber 320, then a plurality of small, circumferentially equally spaced-apart, axially extending holes 322 leading to the radially inner end of a radially extending annular first chamber 324 which leads to an axially upper end of an axially extending, annular second chamber 326, from which the water exits through an annular exit port 328 preferably having divergent walls.

The nozzle body 270 includes the central cylinder 237 surrounded by the recess 226, a first ring 304, a second ring 306, a third ring 308, and O-rings 310 and 312. A pair of bolts 314 holds the assembly of rings to the lower solenoid block 224. The first ring 304 includes the plurality of holes 322 and defines the inlet chamber 320 between itself and the lower block 224 by means of a shoulder 330 on the top of the first ring 304.

The O-rings provide seals between the first ring 304 and the lower block 224. The second ring 306 is a press-fit over the cylinder 237 and abuts the first ring 304 by a shoulder 332 on the second ring that defines the radially extending first annular chamber 324. The third ring 308 is bolted to the lower block 224 through the first ring to define the axially extending second annular chamber 326 and the exit port 328. The annular walls 334 and 336 of the exit port 328 can be any desired shape but are preferably straight and diverging.

In the preferred embodiment, there are 52 of the holes 322 which are each 0.03 inch in diameter and arranged in a circle. The four water passages 256–259 each have a diameter of 0.25 inch. The shoulder on the first ring 304 has a height of about 0.06 inch. The six syrup passageways through the central cylinder each have a diameter of 0.20 inch. The first and third rings 304 and 308 each have a height of about one-half inch.

While the preferred embodiment of this invention has been described above in detail, it is to be understood that variations and modifications can be made therein without departing from the spirit and scope of the present invention.

What is claimed is:

1. A multiflavor nozzle for a postmix beverage dispenser comprising:

(a) a nozzle body having a water passageway and a plurality of separate syrup passageways therethrough;

(b) each of said syrup passageways extending through said body from one of a plurality of separate syrup inlet ports on a top surface of said body to one of a plurality of separate syrup outlet ports on a bottom surface of said body; and (c) said water passageway including:

(i) a water inlet chamber;

(ii) a wall of said inlet chamber having a plurality of small water passage holes therethrough;

(iii) an expansion chamber downstream of said holes such that the major part of the pressure drop of the water flowing through said nozzle occurs through said holes;

(iv) a plurality of separate, equally spaced apart, water ports in said expansion chamber; and (v) water stream shaping device located downstream from said plurality of water ports, said device including firstly a plurality of axially extending water passages, then a radially outwardly extending, first annular chamber downstream from said axially extending passages, and lastly, an axially extending second annular chamber, the distal end of said second annular chamber being an annular water outlet port in a surface of said body.

2. The nozzle as recited in claim 1 wherein said plurality of syrup outlet ports are located radially inside of said annular water outlet port.

3. The nozzle as recited in claim 1 wherein said body is cylindrical and wherein said water inlet chamber is located on said top surface of said body.

4. The nozzle as recited in claim 1 including liquid seal means associated with each of said syrup inlet ports.

5. The nozzle as recited in claim 1 wherein said syrup outlet ports are equally circumferentially spaced apart.

6. The nozzle as recited in claim 1 wherein the top surface of said body includes a circular recess, a flat disc positioned in said recess and extending entirely across said recess and separating said recess into said water inlet chamber above said disc and said expansion chamber below said disc, wherein said disc is said wall of said inlet chamber, and wherein said water passage holes are a plurality of equally circumferentially spaced apart holes through said disc.

7. The nozzle as recited in claim 6 wherein said syrup inlet ports are located radially outwardly of said recess.

8. The nozzle as recited in claim 1 wherein said water passage holes include eight holes each having a diameter of about 0.06 inch, said water passages have a diameter of about 0.22 inch, and said second annular chamber has a radial thickness of about 0.25 inch.

9. The nozzle as recited in claim 1 including a valve block mounted on top of said body, said block having a plurality of syrup passages and a water passage therethrough, and including valve means mounted on said block for controlling the flow through said passages, and wherein each of said block passages has an outlet opening communicating with said body.

10. The nozzle as recited in claim 9 including a solenoid for operating each of said valves.

11. The nozzle as recited in claim 10 wherein said block includes two still water passages and two soda water passages and wherein all four of said water passages have outlet openings communicating with said water inlet chamber.

12. The nozzle as recited in claim 10 wherein said block has a bottom surface with a recess therein and wherein said body has a size and shape as to be sealingly received into said block recess, and wherein all of the outlet ports of said block passages are in said block recess.

13. A method for dispensing a plurality of postmix beverages from a nozzle while minimizing foaming and flavor carry-over comprising the steps of:

(a) providing a nozzle body having a water passageway and a plurality of separate syrup passageways therethrough;

(b) providing each of said syrup passageways extending through said body from one of a plurality of separate syrup inlet ports on a top surface of said body to one of a plurality of separate syrup outlet ports on a bottom surface of said body;

(c) providing said water passageway with a water inlet chamber and feeding water into said water inlet chamber, then through a plurality of small water passage holes in a wall of said inlet chamber and into an expansion chamber downstream from said holes such that the major part of the pressure drop of the water flowing through said nozzle occurs through said holes, then feeding the water from said expansion chamber into a water stream shaping device located downstream from said expansion chamber, including first feeding the water through a plurality of separate, equally spaced apart, water passages extending axially through said body, and then feeding said water into a radially outwardly extending first annular chamber downstream from said axial passages, and then into an axially extending second annular chamber, and then feeding the water from a distal end of said second annular chamber through an annular water outlet port in a surface of said body as a uniform, cylindrical stream of water.

14. The method as recited in claim 13 including feeding syrup from one of said syrup outlet ports simultaneously with feeding water out said annular water outlet port, with said syrup being fed out inside of said cylindrical stream of water.

15. A nozzle for a postmix beverage dispenser comprising:

(a) a nozzle body having a water passageway and a separate syrup passageway therethrough;

(b) said syrup passageway extending through said body from a separate syrup inlet port on a top surface of said body to a separate syrup outlet port on a bottom surface of said body; and (c) said water passageway including:

(i) a water inlet chamber;

(ii) a wall of said inlet chamber having a plurality of small water passage holes therethrough;

(iii) an expansion chamber downstream of said holes such that the major part of the pressure drop of the water flowing through said nozzle occurs through said holes;

(iv) a plurality of separate, equally spaced apart, water ports in said expansion chamber; and (v) a water stream shaping device located downstream from said plurality of water ports, said device including firstly a plurality of axially extending water passages, then a radially outwardly extending, first annular chamber downstream from said axially extending passages, and lastly, an axially extending second annular chamber, the distal end of said second annular chamber being an annular water outlet port in a surface of said body.

16. The nozzle as recited in claim 15 wherein said syrup outlet port is located radially inside of said annular water outlet

17. A method for dispensing a postmix beverage from a nozzle comprising the steps of:

(a) providing a nozzle body having a water passageway and a separate syrup passageway therethrough;

(b) providing said syrup passageway extending through said body from a separate syrup inlet port on a top surface of said body to a separate syrup outlet port on a bottom surface of said body;

(c) providing said water passageway with a water inlet chamber and feeding water into said water inlet chamber, then through a plurality of small water passage holes in a wall of said inlet chamber and into an expansion chamber downstream from said holes such that the major part of the pressure drop of the water flowing through said nozzle occurs through said holes, then feeding the water from said expansion chamber into a water stream shaping device located downstream from said expansion chamber, including first feeding the water through a plurality of separate, equally spaced apart, water passages extending axially through said body, and then feeding said water into a radially outwardly extending first annular chamber downstream from said axial passages, and then into an axially extending second annular chamber, and then feeding the water from a distal end of said second annular chamber through all annular water outlet port in a surface of said body as a uniform, cylindrical stream of water.

18. The method as recited in claim 17 including feeding syrup from said syrup outlet port simultaneously with feeding water out said annular water outlet port, with said syrup being fed out inside of said cylindrical stream of water.

19. A multiflavor nozzle for a postmix beverage dispenser comprising:

(a) a nozzle body having a water passageway and a plurality of separate syrup passageways therethrough;

(b) said nozzle body including a central vertical cylinder and each of said syrup passageways extending vertically, straight down through said central cylinder of said body to a respective one of a plurality of separate syrup outlet ports on a bottom surface of said body; and (c) said water passageway including:

(i) an annular water inlet chamber located radially outwardly from said central cylinder;

(ii) a plurality of relatively small diameter water passage holes extending through said nozzle body from said inlet chamber;

(iii) said holes feeding into the radially inner end of a radially extending, annular first chamber;

(iv) said first chamber feeding into the axially upper end of an axially extending, annular second chamber; and (v) said second chamber feeding into an annular outlet port.

20. The nozzle as recited in claim 19 wherein said plurality of syrup outlet ports are located radially inside of said annular water outlet port.

21. The nozzle as recited in claim 19 wherein said syrup outlet ports are equally circumferentially spaced apart.

22. The nozzle as recited in claim 19 wherein said holes extend axially straight down from said inlet chamber and include about fifty holes each having a diameter of about 0.030 inch.

23. The nozzle as recited in claim 19 including a valve block mounted on top of said nozzle body, said block having a plurality of syrup passages and a water passage therethrough, and including valve means mounted on said block for controlling the flow through said passages.

24. The nozzle as recited in claim 23 including a solenoid for operating each of said valves.

25. The nozzle as recited in claim 24 wherein said block includes two still water passages and two soda water passages and wherein all four of said water passages have outlet openings communicating with said water inlet chamber.

26. The nozzle as recited in claim 24 wherein said block has a bottom surface including said cylinder projecting downwardly therefrom and surrounded by an annular recess into which said first ring is sealingly received.

27. A method of dispensing a plurality of postmix beverages from a nozzle while minimizing foaming and flavor carry-over comprising the steps of:

(a) providing a nozzle body having a water passageway and a plurality of separate syrup passageways therethrough;

(b) providing each of said syrup passageways extending vertically, straight down through a central cylinder of said body to a respective one of a plurality of separate syrup outlet ports on a bottom surface of said body;

(c) providing said water passageway with an annular water inlet chamber and feeding water into said water inlet chamber, then through a plurality of relatively small water passage holes in a wall of said inlet chamber, then into the radially inner end of a radially extending annular first chamber, then into the axially upper end of an axially extending annular second chamber, and then feeding the water from a lower end of said second annular chamber through an annular water outlet port in a bottom surface of said body as a uniform, hollow, cylindrical stream of water.

28. The method as recited in claim 27 including feeding syrup from one of said syrup outlet ports simultaneously with feeding water out said annular water outlet port, with said syrup being fed out inside of said cylindrical stream of water.

29. A nozzle for a postmix beverage dispenser comprising:

(a) a nozzle body having a water passageway and a separate syrup passageway therethrough;

(b) said nozzle body including a central vertical cylinder and said syrup passageway extending vertically straight down through said central cylinder of said body to a syrup outlet port on a bottom surface of said body; and (c) said water passageway including:

(i) an annular water inlet chamber located radially outwardly rom said central cylinder;

(ii) a plurality of relatively small diameter water passage holes extending down through said nozzle body from said inlet chamber;

(iii) said holes feeding into the radially inner end of a radially extending annular first chamber;

(iv) said first chamber feeding into the axially upper end of an axially extending annular second chamber;

(v) said second chamber feeding into an annular outlet port.

30. The nozzle as recited in claim 29 wherein said syrup outlet port is located radially inside of said annular water outlet port.

31. The nozzle as recited in claim 29 wherein said holes extend axially straight down through said cylinder.

32. The nozzle as recited in claim 29 wherein said holes include about fifty holes each having a diameter of about 0.030 inch.

33. A method for dispensing a postmix beverage from a nozzle comprising the steps of:

(a) providing a nozzle body having a water passageway and a separate syrup passageway therethrough;

(b) providing said syrup passageway extending vertically straight down through a central cylinder of said body to a syrup outlet port on a bottom surface of said body;

(c) providing said water passageway with an annular water inlet chamber and feeding water into said water inlet chamber, then through a plurality of relatively small water passage holes in a wall of said inlet chamber, then into the radially inner end of a radially extending annular first chamber, then into the axially upper end of an axially extending annular second chamber, and then feeding the water from a lower end of said second annular chamber through an annular water outlet port in a bottom surface of said body as a uniform, hollow, cylindrical stream of water.

34. The method as recited in claim 33 including feeding syrup from said syrup outlet port simultaneously with feeding water out said annular water outlet port, with said syrup being fed out inside of said cylindrical stream of water.

* * * * *

UNITED STATES PATENT AND TRADEMARK OFFICE

CERTIFICATE OF CORRECTION

PATENT NO. : 5,033,651

DATED : July 23, 1991

INVENTOR(S) : Roger C. Whigham et al.

It is certified that error appears in the above-identified patent and that said Letters Patent is hereby corrected as shown below:

In column 6, line 16, after "(v)", insert --a--.

In column 10, line 8, delete "rom" and insert --from-- therefor.

Signed and Sealed this

Sixth Day of April, 1993

*Attest:*

STEPHEN G. KUNIN

*Attesting Officer*

*Acting Commissioner of Patents and Trademarks*